US009214265B2

(12) United States Patent
Weber et al.

(10) Patent No.: US 9,214,265 B2
(45) Date of Patent: Dec. 15, 2015

(54) SINGLE- OR MULTI-PHASE DRY-TYPE TRANSFORMER HAVING AT LEAST TWO COILS

(71) Applicant: ABB TECHNOLOGY AG, Zürich (CH)

(72) Inventors: Benjamin Weber, Winterberg (DE); Bhavesh Patel, Brilon (DE); Burak Esenlik, Paderborn (DE); Frank Cornelius, Olsberg (DE); Marcos Bockholt, Paderborn (DE); Jens Tepper, Brilon (DE); Rafael Murillo, Zaragoza (ES); Carlos Roy, Zaragoza (ES)

(73) Assignee: ABB TECHNOLOGY AG, Zurich (CH)

( * ) Notice: Subject to any disclaimer, the term of this patent is extended or adjusted under 35 U.S.C. 154(b) by 41 days.

(21) Appl. No.: 13/737,705

(22) Filed: Jan. 9, 2013

(65) Prior Publication Data

US 2013/0127582 A1 May 23, 2013

Related U.S. Application Data

(63) Continuation of application No. PCT/EP2011/003160, filed on Jun. 28, 2011.

(30) Foreign Application Priority Data

Jul. 10, 2010 (EP) ..... 10007133

(51) Int. Cl.

| | |
|---|---|
| ***H01F 27/08*** | (2006.01) |
| ***H01F 27/10*** | (2006.01) |
| ***H01F 27/06*** | (2006.01) |
| ***H01F 27/30*** | (2006.01) |
| ***H01F 5/06*** | (2006.01) |
| ***H01F 27/32*** | (2006.01) |
| *H01F 30/12* | (2006.01) |

(52) U.S. Cl.
CPC ..... *H01F 5/06* (2013.01); *H01F 27/324* (2013.01); *H01F 30/12* (2013.01)

(58) Field of Classification Search
USPC ..... 336/55, 57, 58, 60, 65, 185
See application file for complete search history.

(56) References Cited

U.S. PATENT DOCUMENTS

| | | | | |
|---|---|---|---|---|
| 2,092,779 | A * | 9/1937 | Rietmann | 336/182 |
| 3,302,149 | A | 1/1967 | Forsha | |
| 3,579,162 | A * | 5/1971 | Savkar | 336/57 |

(Continued)

FOREIGN PATENT DOCUMENTS

| | | | |
|---|---|---|---|
| CN | 101 645 348 | A | 2/2010 |
| CS | 271 050 | B1 | 7/1991 |
| WO | WO 2009/138099 | A1 | 11/2009 |

OTHER PUBLICATIONS

International Search Report (PCT/ISA/210) issued on Nov. 18, 2011, by the European Patent Office as the International Searching Authority for International Application No. PCT/EP2011/003160.

*Primary Examiner* — Tsz Chan
(74) *Attorney, Agent, or Firm* — Buchanan Ingersoll & Rooney PC

(57) ABSTRACT

A single- or multi-phase dry-type transformer includes at least two coils. A barrier between phases made of an electrically insulating material is arranged in the intermediate space between the individual coils.

8 Claims, 3 Drawing Sheets

(56) References Cited

U.S. PATENT DOCUMENTS

| | | | | | |
|---|---|---|---|---|---|
| 3,713,061 | A * | 1/1973 | Weber | 336/70 |
| 3,789,337 | A * | 1/1974 | Sheppard | 336/60 |
| 4,173,747 | A * | 11/1979 | Grimes et al. | 336/60 |
| 4,363,012 | A * | 12/1982 | Daikoku et al. | 336/60 |
| 4,673,907 | A * | 6/1987 | Lee | 336/92 |
| 4,837,543 | A | 6/1989 | Humen et al. | |
| 6,424,246 | B1 * | 7/2002 | Kysely et al. | 336/90 |

* cited by examiner 1
4
2
4
3

1
4
5
2
4
5
3

1
6
2
6
3

1
7
8
2
7
8
3

1
9
7
8
2
7
8
9
3

1
9
10
11
2
10
11
9
3

13
14
15
16

19
20
21
14
16

SINGLE- OR MULTI-PHASE DRY-TYPE TRANSFORMER HAVING AT LEAST TWO COILS

RELATED APPLICATION(S)

This application claims priority as a continuation application under 35 U.S.C. §120 to PCT/EP2011/003160, which was filed as an International Application on Jun. 28, 2011 designating the U.S., and which claims priority to European Application 10007133.1 filed in Europe on Jul. 10, 2010. The entire contents of these applications are hereby incorporated by reference in their entireties.

FIELD

The present disclosure relates to a single-phase or polyphase dry-type transformer with at least two coils.

BACKGROUND INFORMATION

In the case of three-phase transformers, the three coils are generally arranged next to one another at an electrically safe distance. For instance, at high voltages, the distances between the coils associated with the three phases are relatively large in order to withstand the voltage loads during the surge voltage withstand testing. This results overall in a less compact design of the transformer.

SUMMARY

An exemplary embodiment of the present disclosure provides a single-phase or polyphase dry-type transformer which includes at least two coils having an interspace arranged therebetween, and an interphase barrier comprised of an electrically insulating material and arranged in the interspace between the at least two coils.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figures 1, 2, 3, 4, 5, 6, 7, 8:
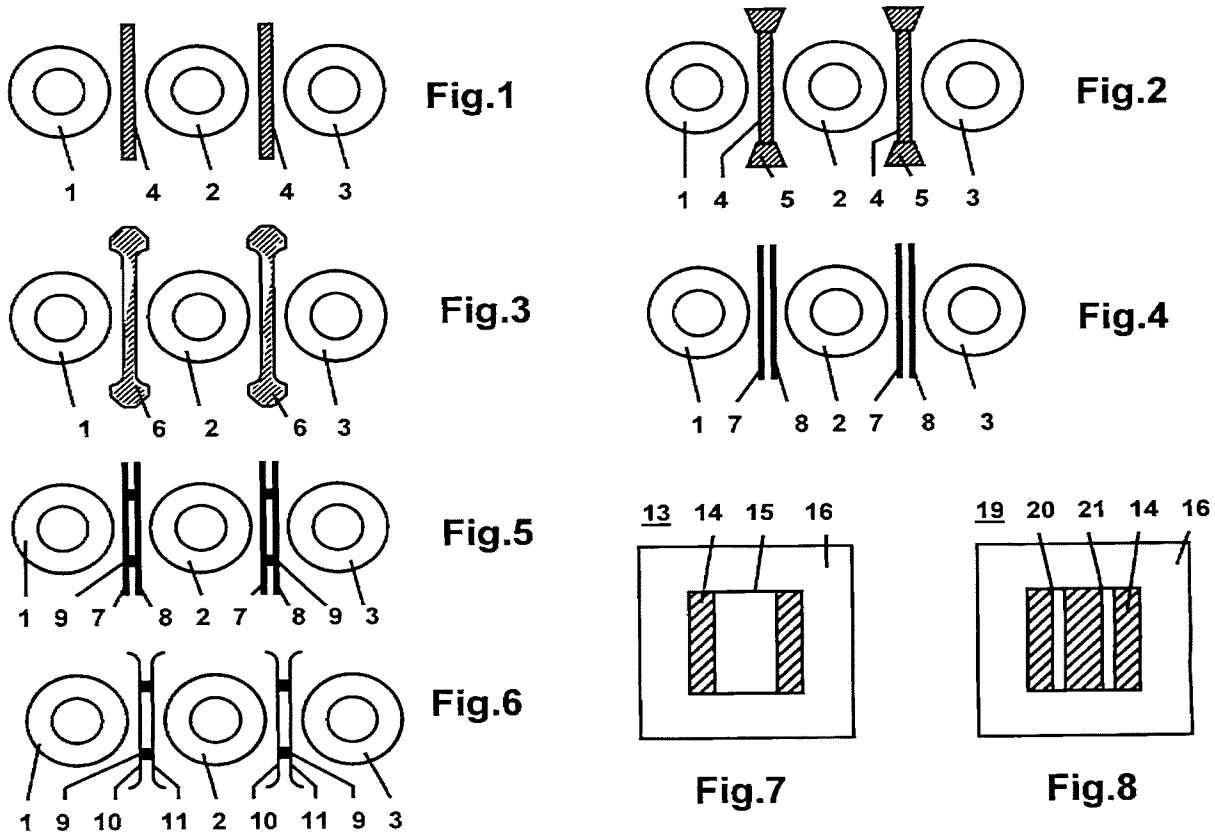
FIGS. 1 to 6 show exemplary embodiments of interphase barriers according to the present disclosure.
FIGS. 7 to 13 show exemplary embodiments of spacers with respect to a pressing bar/yoke of a dry-type transformer according to the present disclosure.

The present disclosure provides a single-phase or polyphase dry-type transformer with at least two coils which enables a compact design even at high voltages.

An exemplary embodiment according to the present disclosure provides a single-phase or polyphase dry-type transformer having at least two coils, wherein an interphase barrier made of (e.g., including in whole or in part) an electrically insulating material is arranged in the interspace between the individual coils.

Two coils can also be used for a single-phase transformer, in which one coil is arranged on each limb of a core with two limbs.

Due to the arrangement of the interphase barriers in the interspace between the individual coils, the required distances between the coils can be significantly reduced. A compact design of the dry-type transformer is thus achieved. In this case, both an individual barrier and a plurality of barriers arranged next to one another can be used per interspace. Such barriers can be connected to one another by means of spacers, which, for example, may not be arranged in the peripheral region in order thus to increase the leakage path as efficiently as possible. Furthermore, in accordance with an exemplary embodiment, a leakage path extension in the form of spacers can be attached to the ends of the barrier in the direction of (grounded) pressing bars/yokes.

Additional features of the present disclosure are explained in more detail below with reference to exemplary embodiments illustrated in the drawings.

FIGS. 1 to 6 illustrate exemplary embodiments of interphase barriers according to the present disclosure. In the drawings, a view of three coils 1, 2, 3, which are arranged next to one another, of a three-phase dry-type transformer is shown, wherein in each case one interphase barrier made of (e.g., including in whole or in part) an electrically insulating material is provided between the coils 1 and 2 and between the coils 2 and 3:

As shown in FIG. 1, plate-shaped barriers 4 in the form of straight, planar, rectangular plates with a predetermined length, width, and height are used as interphase barriers.

As shown in FIG. 2, in each case leakage path extensions 5 are attached to the outer edges (ends) of the plate-shaped barriers 4 as an extension of the configuration in FIG. 1. These leakage path extensions 5 can have, for example, a triangular cross section, as is shown.

As shown in FIG. 3, integral moldings 6 are used for forming the interphase barriers. These integral moldings 6 expediently have, for example, at their outer edges, integrated shapings which extend the leakage path.

As shown in FIG. 4, each interphase barrier is formed in two parts in the form of two plates 7, 8 arranged parallel next to one another.

As shown in FIG. 5, in each case a plurality of spacers 9 are arranged between the two plates 7, 8, as an extension of the configuration shown in FIG. 4. In accordance with an exemplary embodiment, the spacers 9 may not be arranged in the edge region, but offset with respect thereto in the direction toward the center of the plate, in order to thus ensure an extension of the leakage path.

As shown in FIG. 6, as a modification of the embodiments shown in FIG. 4 or 5, two plates 10, 11 arranged parallel to one another are provided with a respective bent-back end piece as parts of the interphase barrier, wherein spacers 9 are optionally provided between these plates 10, 11.

FIGS. 7 to 13 illustrate exemplary embodiments of spacers with respect to a pressing bar/yoke of a dry-type transformer. These spacers are used for creating a defined distance between the interphase barrier and the conventionally grounded pressing bar/yoke of the dry-type transformer. The spacers can be made of (e.g., including in whole or in part) a block of electrically insulating material with at least one slot in its upper side for receiving an interphase barrier, wherein at least one insulating plate protrudes beyond the side faces of the block in order to thus achieve a leakage path extension. The bottom side of the block comes into contact with the pressing bar/yoke. FIGS. 7 to 10 show a view of a spacer:

As shown in FIG. 7, the spacer 13 has a slot 15 in the block 14 beyond which at least one insulating plate 16 protrudes on all sides. The width of this slot 15 corresponds to the width of the plate-shaped barrier 4 or the width of the integral molding 6 or the width of the configuration "plate 7+spacer 9+plate 8" or the width of the configuration "plate 10+spacer 9+plate 11".

As shown in FIG. 8, the spacer 19 has two parallel slots 20, 21 in the block 14, beyond which at least one insulating plate 16 again protrudes on all sides. The width of these slots 20, 21 corresponds to the width of the plates 7, 8 or 10, 11. In accordance with an exemplary embodiment, when using the spacer 19, there is no need for the spacer 9 between the plates 7, 8 or 10, 11.

Figure 9:
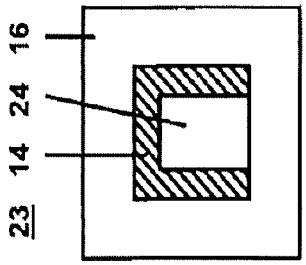

As shown in FIG. 9, the spacer 23 has a slot 24 in the block 14, which slot is closed at one end, which has the advantage that an additional lateral fixing of the interphase barrier is provided, for example, this spacer 23 can be used in the corner regions of the interphase barrier.

Figure 10:
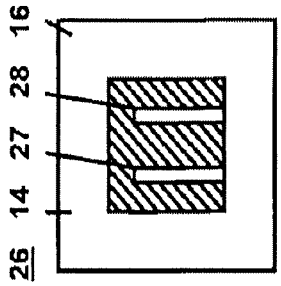

As shown in FIG. 10, the spacer 26 has two slots 27, 28 in the block 14, which slots are closed at one end, which has the advantage that an additional lateral fixing of the plates 7, 8 of the interphase barrier is provided, for example, this spacer 26 can likewise be used in the corner regions of the interphase barrier.

Figure 11:
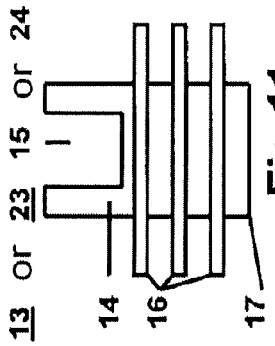

FIG. 11 shows, in supplementary fashion to FIGS. 7 and 9, a side view of a spacer 13 or 23 with block 14, slot 15 or 24 and three parallel insulating plates 16, wherein the bottom side 17 of the block 14 comes into contact with a pressing bar/yoke.

Figure 12:
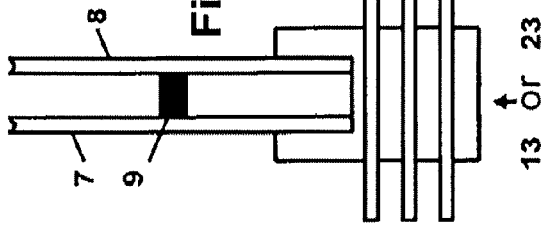

FIG. 12 shows, in supplementary fashion to FIG. 11, a side view of a practical application of a spacer 13 or 23 with a configuration "plate 7+spacer 9+plate 8" inserted into the slot 15 or 24 for providing the interphase barrier.

Figure 13:
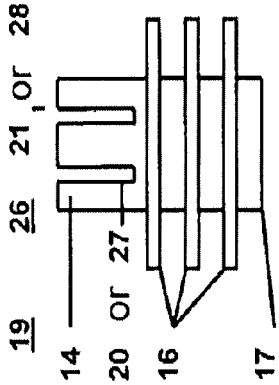

FIG. 13 shows, in supplementary fashion to FIGS. 8 and 10, a side view of a spacer 19 or 26 with block 14, slot 20 or 27, slot 21 or 28 and three parallel insulating plates 16, wherein the bottom side 17 of the block 14 comes into contact with a pressing bar/yoke.

Figure 14:
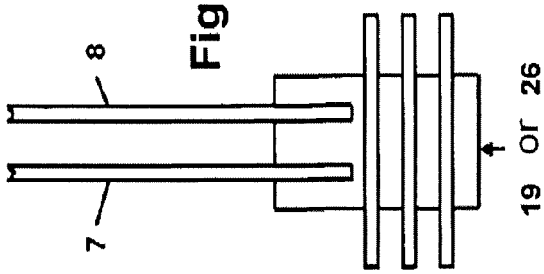

FIG. 14 shows, in supplementary fashion to FIG. 13, a side view of a practical application of a spacer 19 or 26 with a plate 7 inserted into the slot 20 or 27 and with a plate 8 inserted into the slot 21 or 28 for providing the interphase barrier.

Figure 16:
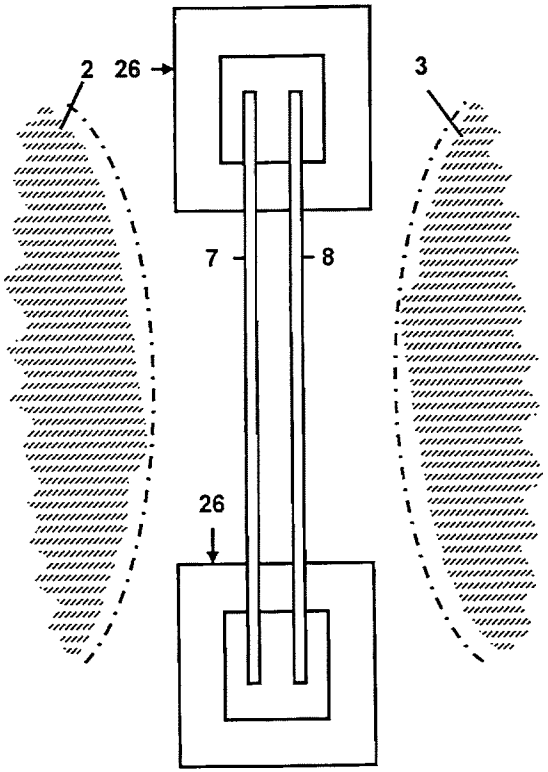
FIGS. 15 and 16 show exemplary embodiments of interphase barriers equipped with spacers.
Figure 15:
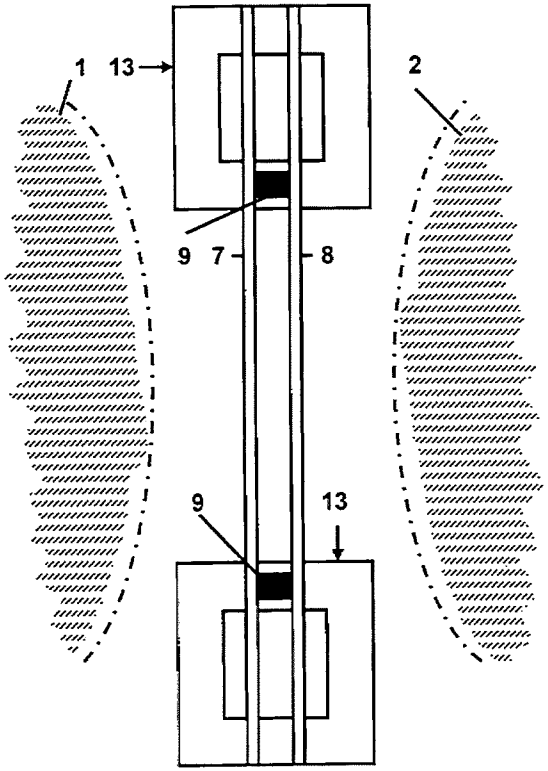

FIGS. 15 and 16 show exemplary embodiments of interphase barriers equipped with spacers. FIG. 15 shows an interphase barrier provided between the coils 1 and 2, which interphase barrier is formed from a configuration "plate 7+a plurality of spacers 9+plate 8", wherein this configuration is inserted in each case into the slots 15 of spacers 13 at the lower and upper outer edge of the configuration.

FIG. 16 shows an interphase barrier provided between the coils 2 and 3, which interphase barrier is formed from two plates 7, 8, wherein these plates are inserted into the slots 27, 28 in spacers 26 at the lower and upper outer edge of the plates in the corner regions.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Coil
2 Coil
3 Coil
4 Plate-shaped barrier as interphase barrier
5 Leakage path extensions at the ends of plate-shaped barrier
6 Integral molding for forming an interphase barrier
7 Plate as part of an interphase barrier
8 Plate as part of an interphase barrier
9 Spacer
10 Plate with respectively bent-back end piece as part of an interphase barrier
11 Plate with respectively bent-back end piece as part of an interphase barrier
13 Spacer with respect to a pressing bar/yoke of a dry-type transformer
14 Block
15 Slot
16 Insulating plate
17 Bottom side of block
19 Spacer with respect to a pressing bar/yoke of a dry-type transformer
20 Slot
21 Slot
23 Spacer with respect to a pressing bar/yoke of a dry-type transformer
24 Slot closed at one end
26 Spacer with respect to a pressing bar/yoke of a dry-type transformer
27 Slot closed at one end
28 Slot closed at one end

What is claimed is:

1. A single-phase or polyphase dry-type transformer comprising:

at least two coils arranged next to each other in respectively non-concentric locations and having an interspace arranged therebetween; and an interphase barrier comprised of an electrically insulating material and arranged in the interspace between the at least two coils, wherein the interphase barrier is in the form of an individual barrier, and wherein the interphase barrier is formed as a plate-shaped barrier in the form of a straight, planar, rectangular plate; and wherein leakage path extensions of the electrically insulating material are located between the at least two coils, and are attached to the outer edges of the plate-shaped barrier and extend along an axis of the plate-shaped barrier within the interspace.

2. The single-phase or polyphase dry-type transformer as claimed in claim 1, wherein the interphase barrier is in the form of a plurality of barriers arranged next to one another.

3. The single-phase or polyphase dry-type transformer as claimed in claim 2, wherein the barriers arranged next to one another each have bent-back end pieces.

4. The single-phase or polyphase dry-type transformer as claimed in claim 2, wherein the barriers arranged next to one another are connected to one another by spacers.

5. The single-phase or polyphase dry-type transformer as claimed in claim 1, wherein the interphase barrier is connected to one of pressing bars and yokes via spacers.

6. The single-phase or polyphase dry-type transformer as claimed in claim 5, wherein the spacer is formed from a block of an electrically insulating material which has at least one slot in its upper side for receiving the interphase barrier and beyond which at least one insulating plate protrudes.

7. The single-phase or polyphase dry-type transformer as claimed in claim 6, wherein the slot for stopping a corner region of the interphase barrier is closed at one end.

8. The single-phase or polyphase dry-type transformer as claimed in claim 1, wherein the interphase barrier is formed as an integral molding with integrated leakage path extensions.

* * * * *